United States Patent [19]

Charles et al.

[11] 4,349,180

[45] Sep. 14, 1982

[54] DEVICE FOR HANDLING FROM A BOAT A SUBMERGED LOAD HOOKED ONTO THE END OF A CABLE

[75] Inventors: Joël M. Charles, Toulon; Robert J. Toscano, La Seyne-sur-Mer, both of France

[73] Assignee: Etat Francais as represented by the Delegue General pour l'Armement, Paris Armees, France

[21] Appl. No.: 177,605

[22] Filed: Aug. 13, 1980

[30] Foreign Application Priority Data

Aug. 27, 1979 [FR] France ..... 79 21425

[51] Int. Cl.[3] ..... B66D 1/26

[52] U.S. Cl. ..... 254/277; 254/288; 254/281; 254/291; 114/254

[58] Field of Search ..... 254/268–273, 254/277, 281, 284–288, 291, 293, 315, 326, 331, 333, 336, 361, 395–397; 114/254, 253, 250, 243–245; 242/54 R, 158.2, 158.3; 212/192, 193, 232, 83

[56] References Cited

U.S. PATENT DOCUMENTS

| | | | |
|---|---|---|---|
| 3,090,496 | 5/1963 | Vertrees et al. | 212/192 |
| 3,112,895 | 12/1963 | Kinney | 242/158.2 |
| 3,118,635 | 1/1964 | Landsem | 254/333 X |
| 3,240,413 | 3/1966 | Young et al. | 242/54 R X |
| 3,456,899 | 7/1969 | Smith et al. | 254/331 X |
| 3,466,013 | 9/1969 | Smith, Jr. | 254/287 |
| 3,494,443 | 2/1970 | Huffhines | 212/193 X |
| 3,536,298 | 10/1970 | Deslierres | 114/254 |
| 3,809,334 | 5/1974 | Bevrer et al. | 242/54 R X |
| 3,967,735 | 7/1976 | Payne | 254/284 |
| 4,108,499 | 8/1978 | Sandberg | 254/269 X |

FOREIGN PATENT DOCUMENTS

| | | | |
|---|---|---|---|
| 2437367 | 5/1980 | France | 242/158.2 |
| 371310 | 9/1963 | Switzerland | 254/287 |

*Primary Examiner*—John M. Jillions

*Attorney, Agent, or Firm*—Stevens, Davis, Miller & Mosher

[57] ABSTRACT

This invention relates to a device for handling a submerged load from a ship. The submerged load is held by a cable which is attached to a cable recovery drum mounted in an anti-rolling cradle located on a turret affixed to the ship's surface. The device includes a straight beam which carries an appliance for straight-line haulage, for example, pairs of wheels equipped with resilient tires, the device being hinged about a transverse axis.

4 Claims, 9 Drawing Figures

DEVICE FOR HANDLING FROM A BOAT A SUBMERGED LOAD HOOKED ONTO THE END OF A CABLE

The object of the present invention is devices for handling from a boat a submerged load hooked onto the end of a cable.

The technical field of the invention is that of the construction of devices for handling, raising and towing of submerged loads from a boat.

The development of works of reconnaissance and exploitation of the bottom of the sea at ever greater depths brings about the necessity of constructing devices which enable the towing from a surface vessel of a submerged load, for example, a fish type of machine which carries apparatus for measurement or reconnaissance and which likewise enables this load to be raised if the occasion arises in order to place it on the vessel.

The load is located at the end of a connecting cable which may be a simple haulage cable or else an electrical conductor cable which includes both a haulage cable and conductors which convey electrical energy and information between the ship and the undersea machine.

This cable may be very thick and very long, and electrical conductor cables, for example, may be employed which have a diameter of the order of 40 mm and a length of the order of 8000 m.

If the connector cable is wound over the drum of a haulage appliance of winch or capstan type or passes over a guide pulley which imposes upon it a change in direction, the cable is then subjected to very large forces of radial compression from which there is a risk of its deterioration. Further, as the vessel is subjected to the motions of the swell, a cable which is wrapped round a drum or a pulley which is locked to the vessel is impaired.

Finally, during the haulage upon the cable, if it is wrapped over a haulage drum at a substantially constant speed, the pounding due to the swell brings about variations in the tension of the cable and excess tensions which may be dangerous.

In order to solve these problems of towing and raising a submerged load from a surface ship, various solutions have been proposed.

One of these solutions consists in employing an appliance for straightline haulage upon the cable, which is placed in front of the drum upon which the cable is wound.

A known appliance for straightline haulage is composed, for example, of a series of pairs of rollers between which the cable passes, and which carry the cable along by friction. Another known appliance for straightline haulage is composed of two worms which are located on opposite sides of the cable and which carry shoes which squeeze the cable between them and which carry it along.

These devices for straightline haulage are bulky because the haulage force which can be exerted upon the cable by friction between two rollers or by adhesion between two shoes is limited and hence the pairs of rollers or the shoes must be multiplied in order to absorb the whole or a large proportion of the tension of the cable.

Nowadays the devices for linear haulage have been placed upon the decks of the ships, which brings about the necessity of making the cable pass over at least one guide pulley located between the load and the haulage appliance. This solution enables the tension to be reduced in the cable which is being wound over the cable recovery drum, but the tension in the cable remains unchanged at the level of the guide pulley and the problems of crushing and fatigue of the length of cable which is bearing against the guide pulley are not solved.

The object of the present invention is an improved device placed on board a surface vessel for handling a cable of great length, onto the end of which is hooked a submerged load.

The aim of the invention is to procure a compact handling device which includes both a cable recovery drum, a device placed in front of it for straightline haulage upon the cable, and means of keeping the straightline haulage device in alignment with the cable in spite of the vertical movements of the vessel due to the swell and in spite of the motions of rolling, pitching or yawing of the vessel.

A device in accordance with the invention for handling from a surface vessel a submerged load hooked to the end of a cable includes in known manner a cable recovery drum and an appliance for straightline haulage upon the cable. The aim of the invention is achieved by means of a device which includes in addition a straight beam the top end of which is hinged about a transverse axis carried by the said ship and which carries the said appliance for straightline haulage upon the cable.

The device preferably includes in addition means of making the said straight beam pivot about the said transverse axis and of automatically keeping the said beam aligned with the direction of the length of cable located beyond the bottom end of the beam.

In accordance with a preferred embodiment the device includes a hydraulic jack which controls the pivoting of the beam about the said transverse axis, an arm which is hinged to the bottom end of the said beam about an axis parallel with the said transverse axis, this arm bearing means of guidance through which passes the said cable, and a pick-up of the angular displacement of the said arm, which automatically controls the said jack in the sense which keeps the said angular displacement substantially zero.

Preferably the appliance for straightline haulage upon the cable is composed of a series of pairs of wheels which are equipped with resilient tires and which are arranged along the said beam, and each pair of wheels includes at least one driving wheel and the said cable passes between the resilient tires on the wheels so that it is carried along linearly by friction.

In accordance with a preferred embodiment, each of the two wheels of each pair of wheels is driven in rotation by a hydraulic motor, the motors being connected in parallel to two hydraulic mains so that each pair of wheels forms a sub-assembly which may be dismounted without thereby bringing about immobilization of the appliance for straightline haulage.

Preferably the straight beam carries at its bottom end a bush integral with the beam, through which passes the cable and into which at the end of its travel there comes to be engaged and locked a part which serves for hooking the load onto the end of the cable.

In accordance with a preferred embodiment the top end of the beam is attached to a bracket which is hinged about a transverse axis carried by a cradle which is hinged with respect to a horizontal axis parallel with the longitudinal axis of the vessel, this horizontal axis being supported by a turret which is carried by the vessel and which pivots with respect to the latter about a vertical axis.

Preferably the cable recovery drum is mounted upon a carriage which is locked to a nut screwed onto a screw which is transverse to the said beam, the screw being carried by the said cradle and being driven in rotation by a reversible hydraulic motor, and the device includes a pick-up which measures the angular deviation between the longitudinal axis of the beam and the direction of the length of cable connecting the beam to the said recovery drum and which automatically drives the said motor in the direction which annuls this deviation.

The result of the invention is a new device for manipulating from a surface vessel a submerged load hooked to the end of a cable.

One advantage of a device in accordance with the invention lies in the fact that the appliance for straightline haulage remains aligned with the cable, whatever the position of the submerged load with respect to the ship. The appliance for straightline haulage exerts upon the cable almost the whole of the force of haulage necessary for towing the load or for drawing it towards the surface vessel.

It is possible to make the maximum force vary, which this appliance for straightline haulage is capable of exerting, by making the pressure vary in the liquid which feeds the hydraulic motors driving the wheels fitted with tires. For example, with a haulage appliance including twenty pairs of driving wheels a maximum force of haulage of 6 tons or of 10 tons may be obtained. Further, at standstill, by locking the wheels against the cable by means of jacks the haulage appliance can withstand a haulage force of 20 tons.

The result is that the winch drum which follows the appliance for straightline haulage is a simple drum for recovery of the cable which is wrapped round it without undergoing any radial crushing.

Another advantage of an appliance in accordance with the invention is that the hinged straight beam which carries the appliance for straightline haulage dips under the water when the vessel is at rest, so that the load is hooked to the end of the beam in a zone where it is not subjected to the effects of the swell.

Thus the beam avoids there being any risk of the cable being caught by the propellor of the vessel.

Again, the bush integral with the bottom end of the beam enables the load to be locked to the beam before bringing it out of the water and the force of raising the load is borne solely by the beam. Thus the cable is never subjected to the total weight of the load in air, which may be several times higher than the apparent weight in the water, which enables a cable of smaller dimensions to be employed.

Another advantage of a device in accordance with the invention is that it forms a compact system thanks to the installation of the beam and of the recovery drum upon one and the same cradle carried at the stern of the ship. Thanks to the articulations of this cradle about a longitudinal horizontal axis and about a vertical axis as well as the hinging of the beam about a transverse axis carried by the cradle, a beam is obtained which has three degrees of pivot with respect to the ship about three axes perpendicular to one another, which enables the cable to be shielded from the effects of pounding and of the motions of rolling, pitching and yawing of the ship.

The description below refers to the attached drawings which represent without any restrictive character an embodiment of a handling device in accordance with the invention.

Figure 2:
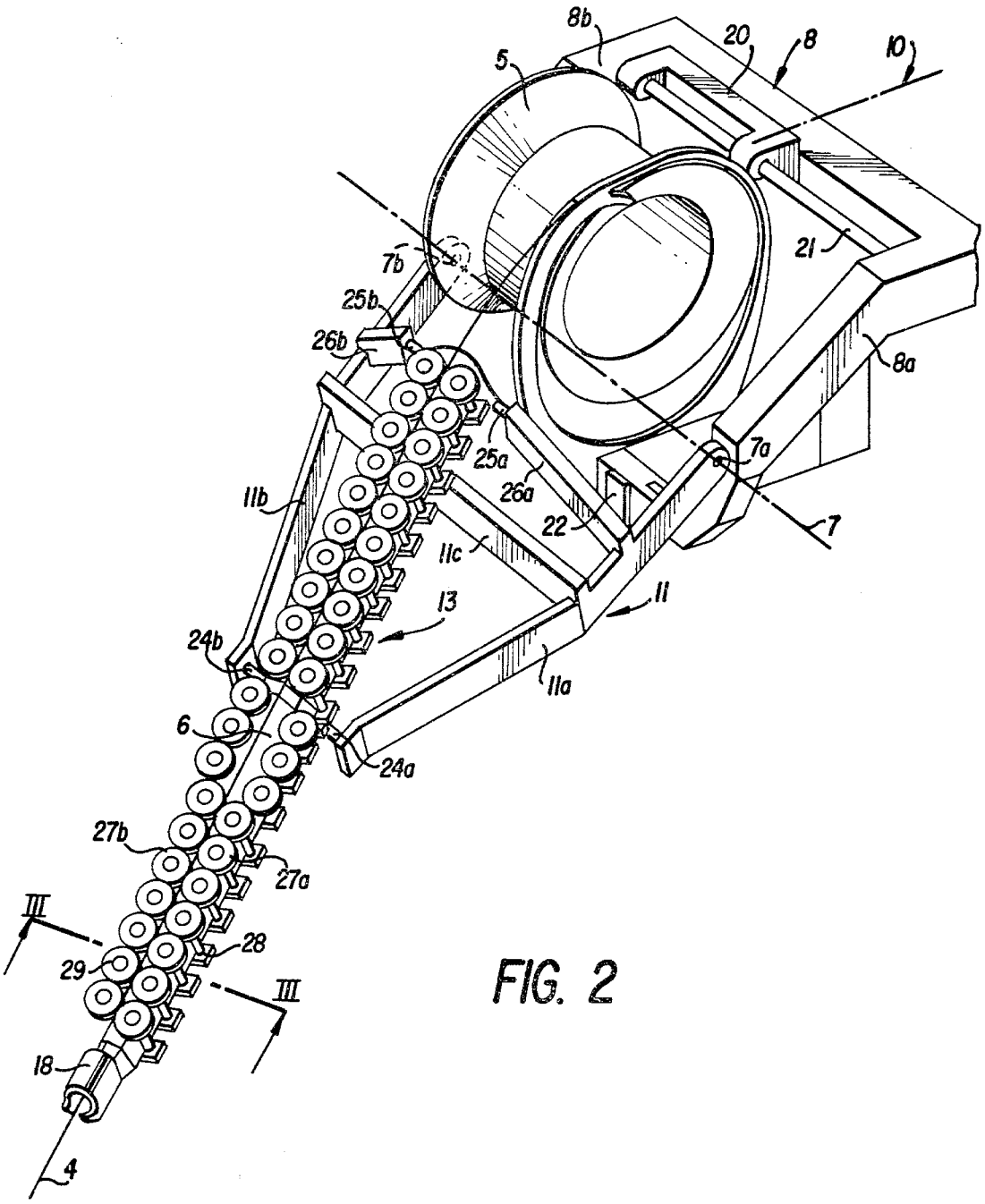
FIG. 2 is a perspective of the handling device on a larger scale.
Figure 3:
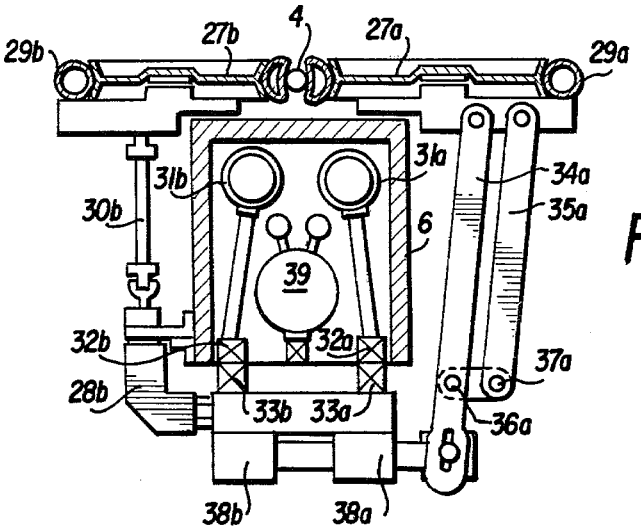
FIG. 3 is a cross-section along III—III in FIG. 2.
Figure 3A:
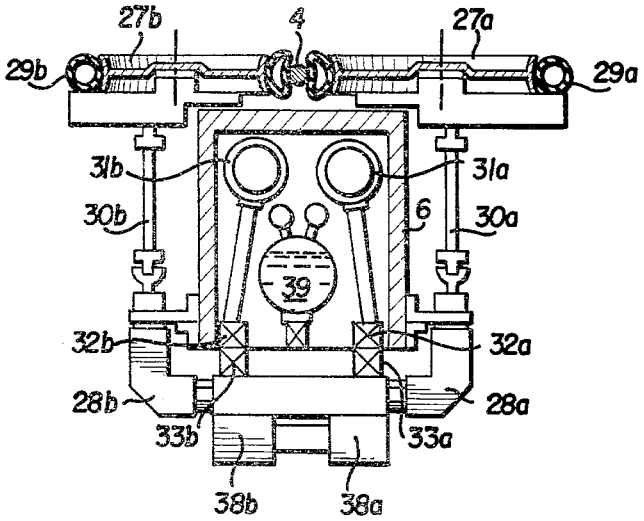

FIG. 3*a* is a cross-section along III—III in FIG. 2 which has been arranged to show both the lefthand and the righthand motors, cardan shafts and cocks.

Figure 3B:
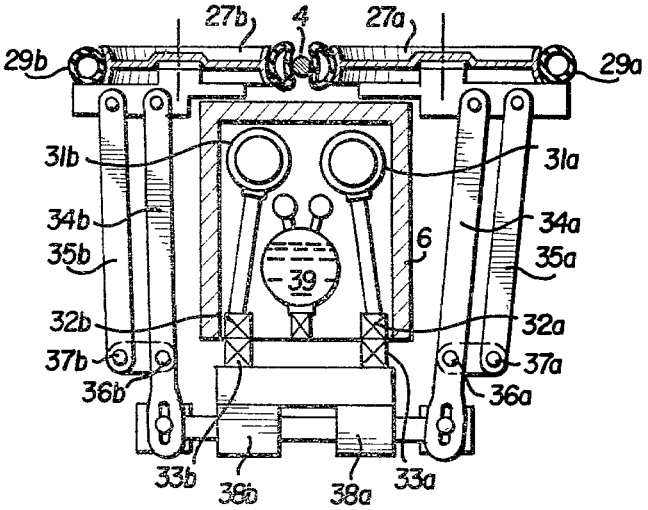

FIG. 3*b* is a cross-section along III—III in FIG. 2 which has been arranged to show the lefthand and righthand connecting-rods whose bottom ends are articulated about two pins.

Figure 4:
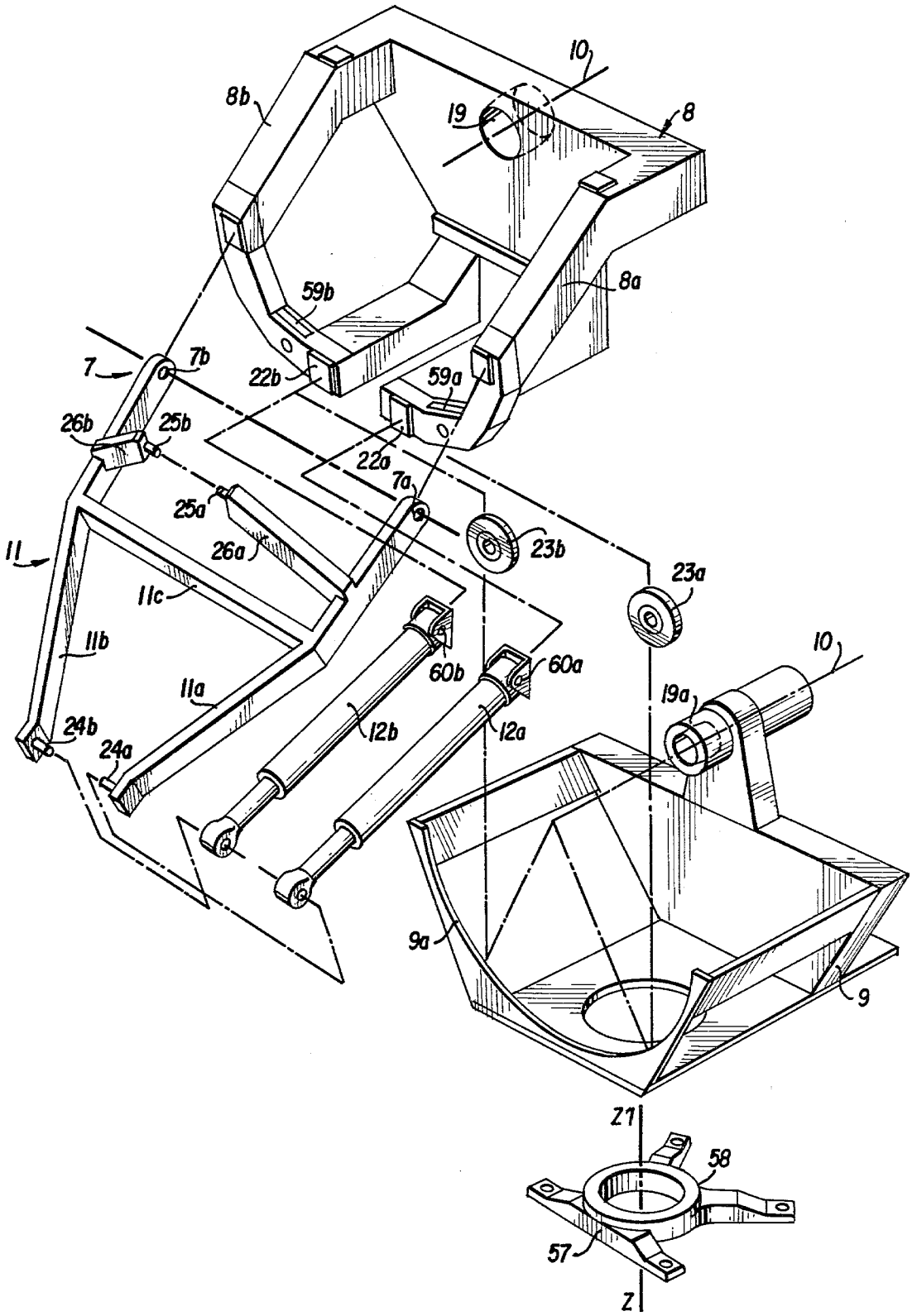

FIG. 4 is an exploded perspective of the anti-rolling cradle and of the turret.

Figure 5:
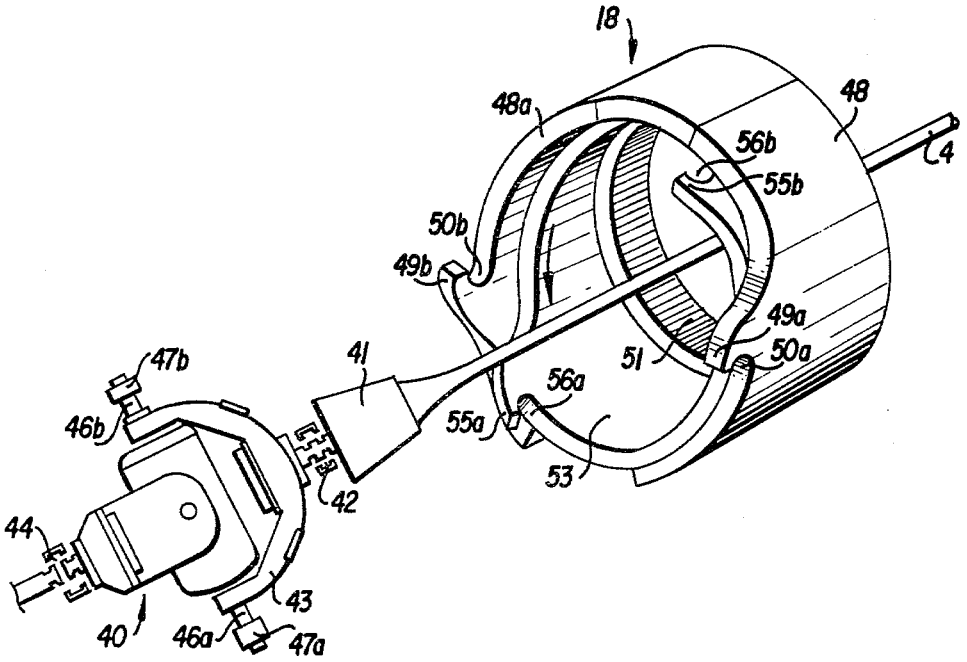

FIG. 5 is a perspective of the anchoring bush attached to the bottom end of the beam.

Figure 6:
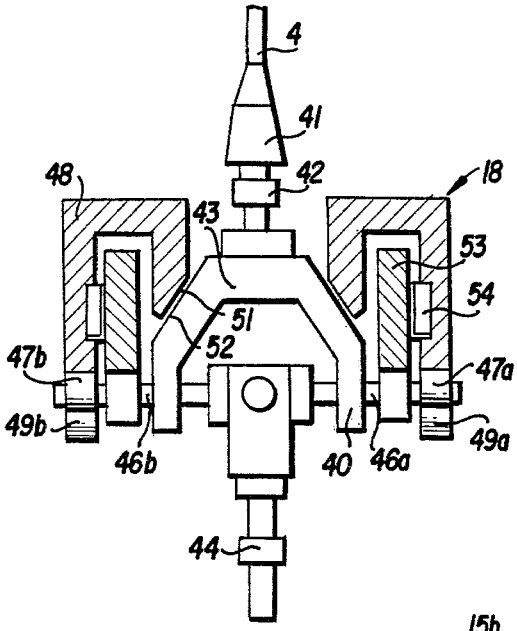

FIG. 6 is an axial section through FIG. 5 after anchoring.

Figure 7:
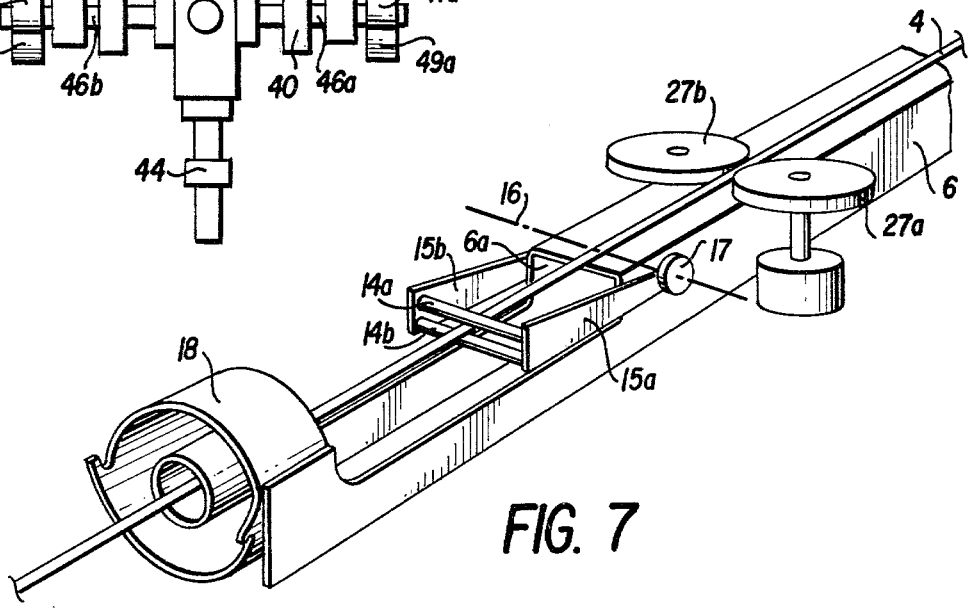

FIG. 7 is a perspective of an embodiment of the bottom end of the beam 6.

The device 1 is intended for handling a submerged load 3 hooked onto the end of a cable 4 which connects it to the vessel. The load 3 is, for example, a device for reconnaissance of deep water, a device for emitting or receiving signals, etc.

A device 1 in accordance with the invention is designed more especially for manipulating loads capable of being submerged at very great depths, of the order of 5 to 10,000 meters, which are connected to the surface vessel by an electrical conductor cable of large diameter and of great length, for example, a cable having a diameter of the order of 40 mm and a length of the order of 10,000 meters.

The handling of a load hooked onto such a cable poses problems which are difficult to solve. It must especially be avoided that there is any risk of the cable which is subjected to high tensions, being crushed if it is wound under tension round a drum or if it passes over a guide pulley which compels it to change direction. It must likewise be avoided that the pounding of the ship due to the swell when the ship has stopped or that the various motions of the ship under way due to rolling, pitching or yawing of the ship are reflected in the connecting cable and introduce a risk of bringing about breakage of this cable or rapid deterioration of it by the fatigue due to the repeated variations in tension.

A device 1 in accordance with the invention enables these problems to be solved.

The device 1 is intended either to tow the submerged load 3 from the vessel 2 or to lower a load 3 and raise it again from a stationary vessel 2.

The device 1 in accordance with the invention includes a cable recovery drum 5 which is a drum of large diameter, for example, a drum having a diameter of 4 meters capable of containing 8000 m of cable of 40 mm diameter. This drum is driven in rotation by a hydraulic motor. It is not a question of a winch drum which exerts powerful haulage upon the cable but of a drum intended solely for reeling up and unreeling the cable.

The device 1 includes in addition a straight beam 6 the top end of which is hinged about an axis 7. The axis 7 is carried by an anti-rolling cradle 8 which carries the recovery drum 5. The axis 7 is transverse to the beam 6 and to the longitudinal axis of the vessel. The cradle 8 is mounted upon a turret 9 placed at the stern of the vessel 2. The turret 9 is hinged with respect to the vessel about a vertical axis z–z1. Again, the anti-rolling cradle 8 is hinged with respect to the turret about a horizontal axis 10 parallel with the longitudinal axis of the ship.

In accordance with a preferred embodiment the hinging of the cradle 8 about the axis 10 is replaced by a ball joint articulation. The cradle 8 includes wheels which roll on a circular rail 9*a* carried by the turret and centered upon the longitudinal axis 10.

Thanks to the three articulations about the horizontal axes 7 and 10 and about a vertical axis z–z1, the vessel and the beam 6 are dissociated in rotation and the motions of the ship due to pounding, rolling, pitching or yawing of the ship are not transmitted to the beam 6.

Figure 1:
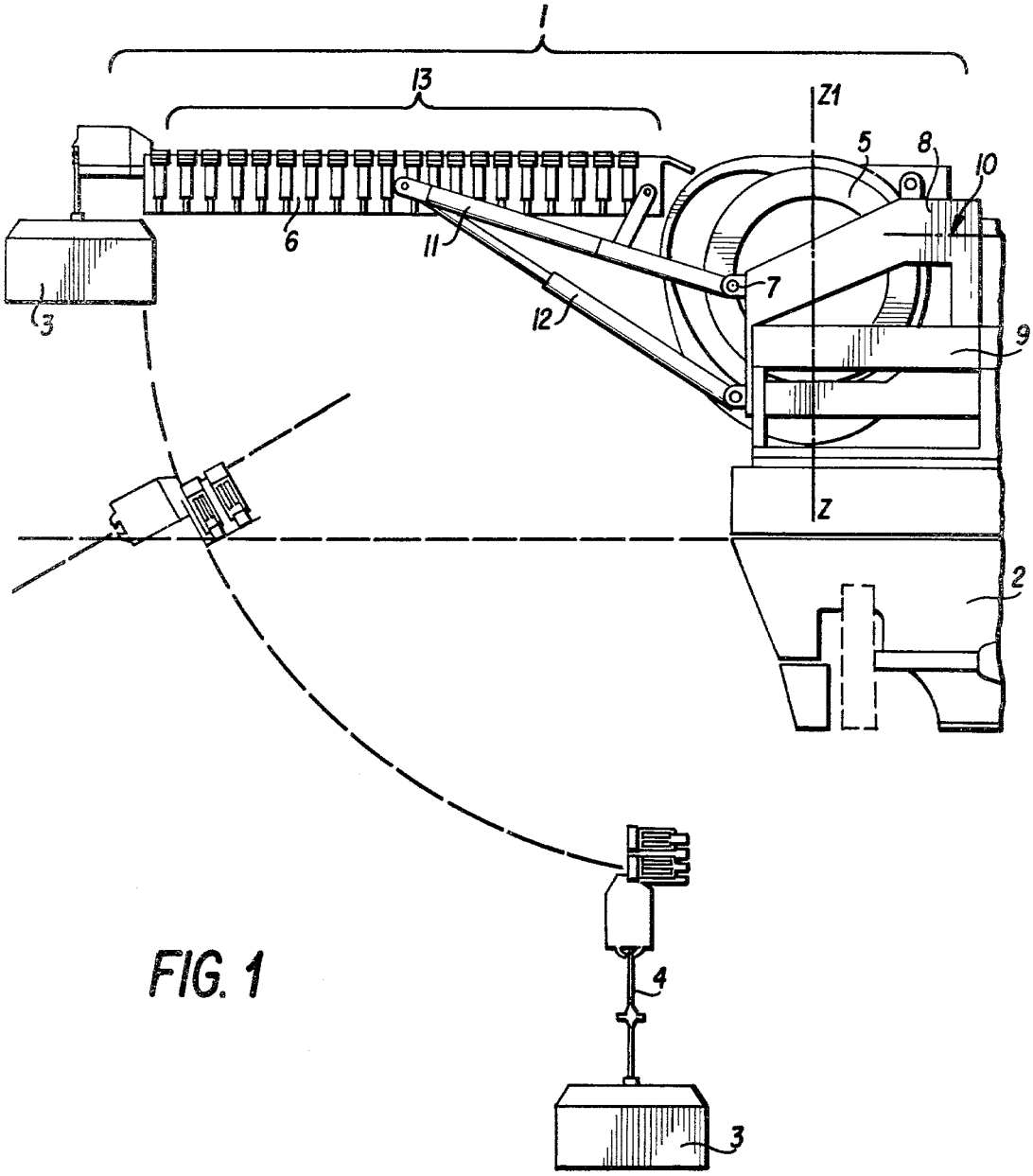
FIG. 1 is a diagrammatic representation of a handling device 1 installed at the stern of a surface vessel 2.

The beam 6 has a length such that its bottom end dips below the surface of the water to a depth of the order of 5 meters, that is to say, lower than the propellors of the vessel and to a depth where the load 3 is shielded from the effects of the swell. In FIG. 1 is shown in dotted line the extreme position of the beam when the vessel 2 is stationary.

The beam 6 carries an appliance for straightline haulage 13 of any known type, which is arranged all along the beam. The top end of the beam 6 is attached to a bracket or brace 11 in the form of a fork having two arms. Each of the arms is connected to one end of the anti-rolling cradle 8 by a hinge and the two hinges define the transverse axis 7.

Two hydraulic jacks 12 connect the anti-rolling cradle 8 and the brace 11 and enable the rotations of the beam 6 to be controlled about the transverse axis 7 and thus the slope of the beam 6 to be controlled.

The device 1 includes means of keeping the beam 6 automatically aligned with the direction of the length of cable located immediately beyond the bottom end of the beam.

A conical bush 18 is attached to the bottom end of the beam 6. The cable 4 passes through this bush. At the end of its travel, when the submerged load 3 comes to a stop against the bottom end of the beam, the part which serves to hook the load onto the end of the cable engages inside the bush 18. It will be explained later how the load is then locked to the bush 18 so that the cable 4 is no longer subjected to tension from this locking during the manipulations of raising the load to the surface by means of the beam 6 and the jacks 12.

FIG. 2 is a perspective on a larger scale of the anti-rolling cradle 8, the brace 11, the straight beam 6 and an embodiment of the appliance 13 for straightline haulage upon the cable 4.

The anti-rolling cradle 8 has at the rear a seating of cylindrical or spherical shape of axis 10, in which is seated a cylindrical stud or a spherical swivel carried by a turret which pivots about a vertical axis.

The cradle 8 includes two side-arms 8*a* and 8*b* which form a fork and define between them a gap in which lies the drum 5 for recovery of the cable 4.

The drum 4 is mounted upon a carriage 20 which slides to and fro upon a guide rod 21 carried by the cradle 8. The carriage 20 bears a nut which is screwed onto a threaded rod (not shown) parallel with the guide rod 21. This threaded rod is driven in rotation by a reversible hydraulic motor (not shown). The rotation of the threaded rod moves the carriage 20 and the drum 5. A pick-up of angular movement (not shown) is arranged at the top end of the beam 6 and this pick-up measures the angular deviation in a plane parallel with the rod 21, between the longitudinal axis of the beam and the direction of the length of cable running from the beam to the drum 5. This pick-up controls automatically the motor which drives the endless screw and moves the carriage 20 in the direction which keeps this angular deviation zero.

In FIG. 2 may be seen the two hinges 7*a* and 7*b* of the two arms of the brace 11 on the ends of the two arms 8*a* and 8*b*. The hinges 7*a* and 7*b* define the axis 7 of the beam 6 with respect to the cradle 8. In FIG. 3 the plate 22 may likewise be seen, against which bears one of the two jacks 12 which enable the slope of the beam 6 to be varied. The jacks 12 are not represented in FIG. 2.

Each of the two arms 8*a* and 8*b* of the cradle 8 carries a grooved roller which runs on a circular rail (not shown) carried by the pivoting turret. This circular rail is centered upon the axis 10.

FIG. 2 represents a preferred embodiment of the appliance for straightline haulage 13. In this embodiment this appliance is composed of a plurality of pairs of wheels 27*a* and 27*b* located on opposite sides of the beam 6. Each wheel is driven by a hydraulic motor such as the motor 28. The wheels are equipped with resilient tires 29, preferably inflatable pneumatic tires.

The pairs of wheels are placed side by side along the beam. For example, the appliance includes twenty pairs of wheels. The cable 4 passes between the wheels. The two wheels of each pair are mounted upon hinged parallelograms which under the action of a jack enable them to be brought together in order to squeeze the cable which is carried along by friction, or to separate them from one another.

In FIG. 2, by way of example, three pairs of wheels have been shown in the separated position.

FIG. 3 is a cross-section along III—III in FIG. 2.

In this Figure may be seen the section through the beam 6 which exhibits a cross-section the shape of a U the opening in which is turned downwards. The two wheels 27*a* and 27*b* may be seen, equipped with pneumatic tires 29*a*, 29*b* between which passes the cable 4. The wheels and the cable are located on top of the beam 6. The lefthand half of FIG. 3 shows the driving of the wheel 27*b* in rotation by a cardan shaft 30*b* which is driven by a hydraulic motor 28*b*. The cross-section has a slight offset and the motor 28*a* for driving the wheel 27*a* is not shown. However, FIG. 3*a* shows a cross-section wherein the motor 28*a* is shown along with cardan shaft 30*a* and cock 32*a*. The mains 31*a* and 31*b* which run inside the beam feed the motors with liquid under pressure. Two successive cocks 32*b* and 33*b* isolate the main 31*b* from the motor 28*b*. The cock 32*b* is fixed to the main 31*b* while the cock 33*b* can be dismounted at the same time as the wheels and the motor. Similarly, the main 31*a* is isolated from the motor 28*a* by two cocks in series 32*a* and 33*a*, the latter being dismountable with the wheels and the motors.

The righthand portion of FIG. 3 represents the means of support of the wheel 29*a*. These supports are composed of two pairs of connecting-rods 34*a* and 35*a*, the bottom ends of which are articulated about two pins 36*a* and 37*a* located in a plane parallel with the top of the beam, and the top ends of which are hinged onto a head which carries the wheel 29*a*. FIG. 3*b* represents the means of support of the wheel 29*a* as well as the wheel 29*b*.

The two connecting-rods such as 34*a* and 35*a* form part of a hinged parallelogram of which the side 60 is fixed so that the wheels 27*a*, 27*b* move in translation while remaining parallel with the top of the beam 6.

Two jacks 38*a* and 38*b* enable the parallelograms to be deformed in order to separate the wheels or to bring them together. These jacks are fed from an oleopneumatic reservoir 39 housed inside the beam.

The jacks 38*a*, 38*b* are isolated from the oleopneumatic reservoir by two cocks mounted in series. One of the cocks is dismountable at the same time as the jacks and the connecting-rods.

The assembly formed by two wheels, the connecting-rods which support them, the jacks which actuate the connecting-rods and the motors which drive the wheels, form a unit or module which may be dismounted as one without this dismounting bringing about immobilization of the device which can continue to operate after the dismounting of one module.

The oleopneumatic reservoir 39 forms a reserve of energy which in the event of breakdown of the hydraulic system or rupture of the mains 31*a*, 31*b* enables the two wheels 27*a*, 27*b* to be brought together and kept bearing hard against the cable which becomes locked. In this position braking the cable, an appliance for straightline haulage in accordance with the invention can withstand a haulage force of one ton per pair of wheels.

The motors 28*a* and 28*b* which drive the wheels are connected in parallel to the mains 31*a* and 31*b*. The result is that the pressure of feed to all of the motors is substantially the same. However, the tension of the cable varies along the appliance for straightline haulage and the elongation of the cable diminishes as one approaches the top end of the beam.

The appliance for straightline haulage in accordance with the invention enables this difference in length to be taken up without there being slipping of the cable. The speeds of rotation of the wheels are adapted automatically to the linear speeds of the cable.

FIG. 4 is an exploded perspective of the anti-rolling cradle 8, of the brace 11 and of the turret 9.

In this Figure may be seen the two arms 8*a* and 8*b* of the cradle, bearing at their bottom ends two seatings 59*a* and 59*b* of the two rollers 27*a* and 27*b* represented separately. The two rollers 23*a* and 23*b* roll on the circular rail 9*a* which forms part of the turret 9. The seating 19 may likewise be seen, which is cylindrical or in the form of a spherical drum of axis 10. There may likewise be seen at the bottom ends of the two arms 8*a* and 8*b* the surfaces 22*a* and 22*b* against which bear the two jacks 12*a* and 12*b* which are shown separately with their hinges 60*a* and 60*b*. The two jacks 12*a* and 12*b* enable the brace 11 to be made to pivot about the axis of hinge 7 and the slope of the beam 6 to be made to vary with respect to the cradle 8 and the turret 9.

FIG. 4 shows the brace 11 which has two side arms 11*a* and 11*b* joined together by a crossbar 11*c*. The top ends of the arms 11*a* and 11*b* carry seatings 7*a* and 7*b* of the hinges which define the axis 7.

The bottom ends of the arms 11*a* and 11*b* carry two trunnions 24*a* and 24*b* which engage in two corresponding seatings in the beam 6. Two other trunnions 25*a* and 25*b* are carried each by a half-cross-piece 26*a* and 26*b* and engage in two seatings carried by the flanges of the beam 6. The beam 6 is made integral with the brace 11 when the four trunnions 24*a*, 24*b*, 25*a* and 25*b* engage in their seatings. The half-crosspieces 26*a* and 26*b* are inclined upwards so that the beam 6 makes an angle with the plane of the brace 11.

FIG. 4 likewise shows the sole 57 which is attached to the deck of the ship 2 and which bears a circular rollway 58 centered upon the vertical axis z–z1.

FIG. 4 again shows the turret 9 which is mounted to pivot about the rollway 58. The turret 9 carries a pivot 19*a* which is cylindrical or in the form of a spherical drum of axis 10 which is seated in the seating 19. It likewise carries the circular rail 9*a* of axis 10 upon which roll the rollers 23*a* and 23*b*. The turret 9 likewise carries a motor (not shown) which drives it in rotation about the axis z–z1 and which enables the load 3 to be brought onto the deck.

FIG. 5 is a perspective of the anchoring bush 18 attached to the bottom end of the beam 6. This Figure likewise shows the part 40 which serves for hooking the load 3 onto the end of the cable 4 which passes through the bush 18.

FIG. 6 is an axial cross-section of the coupling-piece 40 when engaged and locked into the bush 18.

The cable 4 bears a guide cone 41 attached to the front of the anchor piece, which has the effect of centering the cable in the bush 18 and the end of the travel of the load.

The anchor piece 40 includes a first swivel 42, a universal joint 43 and a second swivel 44. One of the two arms of the crosspiece of the universal joint includes extensions 46*a* and 46*b* on opposite sides of the arches of the universal joint, these extensions bearing each a roller 47*a* and 47*b* respectively.

The bush 18 includes an outer cylindrical bush 48 which is attached to the bottom end of the beam 6. The front edge 48*a* of this bush exhibits a skew-dog shape, that is to say, it has two extensions towards the front, diametrically opposite, the shape of hooks 49*a* and 49*b* which outline two notches 50*a* and 50*b* intended for receiving the two rollers 47*a* and 47*b*. The rear edge of the bush 48 is bent back towards the front and defines a tapered bearing surface 51 which widens towards the front and which is intended to serve as the bearing for a tapered bearing surface 52 attached to the upper arch of the universal joint 40.

The bush 18 includes in addition a second movable inner ring 53 concentric with the bush 48, which can pivot about the common axis. A roller bearing 54 interposed between the ring 53 and the outer bush 48 facilitates the pivoting. The front edge of the ring 53 likewise includes two hooks 55*a* and 55*b* which extend forwards and which define two diametrically opposite notches 56*a* and 56*b* intended for receiving the extensions 46*a* and 46*b* as is seen in FIG. 6.

Operation is as follows.

When the submerged load 3 arrives at the end of its travel, the tapered bearing surface 52 comes to bear against the tapered bearing surface 51. The axis defined by the extensions 46*a*, 46*b* then occupies any angular position and the rollers 47*a* and 47*b* come to bear against the front edge 48*a* of the outer bush 48. The inner ring 53 is then made to pivot in the direction of the arrow F so that the shaft ends 46*a* and 46*b* come and seat in the notches 56*a* and 56*b*. By continuing to make the inner ring turn, the universal joint 40 is driven in rotation and the rollers 42*a* and 42*b* roll along the front edge 48*a* until they come to a stop against the hooks 49*a* and 49*b*. The swivels 42 and 44 dissociate the universal joint in rotation from the two sections of cable situated on opposite sides of the joint. Once the universal joint has been placed in the position as FIG. 6 it is locked to the bush 18 and the cable 4 is no longer subjected to any force of haulage. By manipulating the beam 6 the load 3 can then be brought out of the water without the cable 4 having to support the real weight of the load 3 out of the water.

FIG. 7 represents an embodiment of the bottom end of the beam 6.

In this Figure may be seen the last pair of wheels 27*a* and 27*b* which form the bottom end of the device for linear haulage.

There may also be seen the bush 18 attached to the bottom end of the beam 6.

FIG. 7 represents an embodiment of the means intended for keeping the beam 6 automatically aligned with the direction of the length of cable 4 located immediately beyond the bottom end of the beam. These means include a cable guide, for example, two rollers 14*a* and 14*b* mounted upon two arms 15*a* and 15*b* which are hinged about an axis 16 parallel with the axis 7.

As a variant, the rollers and the hinged arms may be placed inside the bush 18.

A pick-up of angular displacement 17, for example, a potentiometer, is mounted upon the axis of hinge. This pick-up delivers an electrical signal proportional to the deviation of the arms with respect to an original position which is that in which the length of cable is parallel with the longitudinal axis of the beam 6. The pick-up 17 automatically controls the two jacks 12*a* and 12*b* and makes the slope of the beam 6 vary automatically in the direction which keeps this deviation substantially zero.

Of course, without departing from the scope of the invention, the various constituent parts of the device which has just been described by way of example, may be replaced by equivalent members fulfilling the same functions.

We claim:

1. A device for handling, from a ship, a submerged load hooked to one end of a cable, comprising:

a cable recovery drum;

an appliance for straightline haulage upon the cable;

a straight beam with a top end and a bottom end, the appliance being disposed along and carried by said beam between said top and bottom ends, the top end hinged about a first axis transversally disposed with respect to the ship;

a hydraulic jack for controlling pivoting of the beam about said first axis;

an arm hinged to the bottom end about a second axis parallel with the first axis;

a means of guidance through which the cable passes, said means of guidance being borne by the arm; and a pick-up of angular displacement of the arm, said pick-up automatically controlling the hydraulic jack to keep said angular displacement substantially zero.

2. A device for handling, from a ship, a submerged load hooked to one end of a cable, comprising:

a cable recovery drum;

an appliance for straightline haulage upon the cable;

a straight beam with a top and a bottom end, the appliance being disposed along and carried by said beam between the top and bottom ends, the top end being hinged about a first axis transversally disposed with respect to the ship;

a bush carried at and integral with the bottom end of the straight beam, the cable passing through said bush, said bush comprising:

a front edge equipped with two diametrically opposite hooks standing out with respect to the front edge;

a rear edge which is bent back towards the inside of the bush to form a tapered bearing-surface;

a movable ring concentric with the front edge, said movable ring having a ring front edge which has two diametrically opposite hooks standing out with respect to the ring front edge; and an anchor piece connecting one end of the cable to the submerged load, the shaft ends of said anchor piece being stopped by the hooks of the movable ring.

3. A device according to claim 1 or 2, in which the appliance for straightline haulage comprises a series of pairs of wheels which are equipped with resilient tires and which are arranged along the straight beam, each pair of wheels having at least one driving wheel, the cable passing between the resilient tires on the wheels so that it is carried along linearly by friction.

4. A device as in claim 3, in which the two wheels of each pair of wheels are driven in rotation each by a hydraulic motor and the motors of all of the pairs are connected in parallel to hydraulic mains which are housed inside the beam, so that each pair of wheels forms a subassembly which may be dismounted without thereby bringing about immobilization of the appliance for straightline haulage.

* * * * *